United States Patent [19]

Subrick

[11] 4,068,728

[45] Jan. 17, 1978

[54] HYDRAULIC FLOW DIVIDER FOR A MINING VEHICLE

[75] Inventor: Joseph Subrick, Gary, W. Va.

[73] Assignee: United States Steel Corporation, Pittsburgh, Pa.

[21] Appl. No.: 686,963

[22] Filed: May 14, 1976

[51] Int. Cl.[2] ..... E21C 11/02

[52] U.S. Cl. ..... 173/27; 60/420

[58] Field of Search ..... 173/27, 28, 59; 60/420, 60/484; 137/100, 101

[56] References Cited

U.S. PATENT DOCUMENTS

| | | | |
|---|---|---|---|
| 2,646,968 | 7/1953 | Curtis | 173/27 |
| 3,017,935 | 1/1962 | Galbraith et al. | 173/27 |
| 3,252,525 | 5/1966 | Pyles | 173/27 |
| 3,319,727 | 5/1967 | Pyles | 173/27 |
| 3,815,689 | 1/1974 | Kuhl | 173/27 |
| 3,841,095 | 10/1974 | Baker | 137/101 |
| 3,842,602 | 10/1974 | Ziegler et al. | 60/420 |
| 3,866,418 | 2/1975 | Waters | 60/420 |

*Primary Examiner*—Robert A. Hafer

*Attorney, Agent, or Firm*—William A. Danchuk

[57] ABSTRACT

A hydraulic flow dividing and proportioning system is provided for use in conjunction with a multi-function mining vehicle. In a preferred embodiment of the invention, the hydraulic system is employed for powering a roof bolting vehicle having the power requiring functions of drill rotation, drill thrusting and vehicle tramming. The system, utilizing a single hydraulic pump, provides for the efficient and selective pumping of hydraulic fluid to those power requiring elements when necessary. The system additionally includes a hydraulic flow proportioner which provides for a smooth and even tramming transition from a stop condition to full drive condition.

11 Claims, 3 Drawing Figures

HYDRAULIC FLOW DIVIDER FOR A MINING VEHICLE

BACKGROUND OF THE INVENTION

In underground mining in general, and in coal mining specifically, there is constant and well deserved attention paid to supporting the mine roof. There are a variety of ways in which roof support may be effected in "conventional" mines as well as in those mines which employ mining methods described as short wall and/or long wall mining. In "conventional" mines support is usually provided to a previously unsupported (and usually just mined) area of mine roof through conventional roof bolts and the like. These bolts are inserted into substantially vertically drilled holes into the mine roof by a bolter apparatus and generally have shapes, designs and lengths which depend, as least to a large extent upon the geographical makeup of the mine, the coal being mined, and the mine roof. The roof bolts with conventional, expandable, wedge-type members and bearing plates, as well as the "less conventional" and "newly" introduced resin bolts, tie the overhead strata together, thereby reducing and hopefully eliminating the possibility of roof falls. In the areas of conventional mining, where large blocks of coal are dislodged from the coal face, it is necessary to place these roof bolts along predetermined rows and files throughout the length and width of substantially all of the mined area. Moreover, there are federal, state and county regulations which stipulate exactly how much length of unsupported mine roof may be present between the last roof bolt and the coal face. These regulations are strictly followed by mine personnel because of the relationship between roof falls and unsupported mine roof areas between the last row of bolts and the face being mined. The gamble of men and equipment is far too great to extract coal and support the mine roof in any other way within "conventional" mining environments.

Under current mining regulations it is necessary, subsequent to the extraction of coal from the face, to move a portable self-propelled bolter vehicle into the haulageway and set both rows and files of roof bolts into the mine roof to reduce the length of unsupported roof. Generally, the maximum length of allowable unsupported roof is approximately twenty feet. When such a length has been reached, the coal miner is extracted and the bolting operation commences for that given area. The roof bolts which are set into the predrilled holes in the mine roof have center to center premissible distances of four feet with a maximum four-foot distance between the rib and the next inward bolt. Roof bolting machines currently available must drill and set successive series (usually three or four) of roof bolts (having a width of between two and four roof bolts) across the longitudinal axis of the haulageway, continuing down the haulageway until four rows have been set and the roof is again supported. Each of these successive lateral drilling series necessitates the retraction of temporary roof supports, the movement or tramming of the drilling vehicle four feet further into the passage and the positioning of the drilling machine so that the next series of holes drilled will be four feet from the last.

The drilling operation itself includes the steps of rotating the drill steel and drill head as well as providing the necessary upward thrust to the two in order to effect proper drilling into the mine roof. After the drilling operation has been accomplished for a given bolting vehicle position (usually four holes drilled by two drilling units), the vehicle is moved or trammed to another location where drilling is desired. For the most part, these functions are almost always hydraulically powered, although exceptions do occur.

The currently available roof drilling and bolting apparatus employ a plurality of hydraulic pumps and hoses to carry sufficient hydraulic fluid to the hydraulically actuated motors, jacks and other elements necessary for the proper operation of a roof bolting machine. The inclusion of the numbers of such equipment into such vehicles results in a complicated, expensive mechanism which is more difficult to maintain. The pumps and other hydraulic elements of these systems generally have limited use inasmuch as they are utilized only during the operation of the very specific element they are designed to power. The currently available hydraulic systems are cumbersome, expensive and inefficient both in terms of the amount of equipment and its power usage.

SUMMARY OF THE INVENTION

The present invention is addressed to a hydraulic flow divider and proportioner system for use in conjunction with a multi-function mine vehicle. In a preferred embodiment of the invention, the mine vehicle is configured as a portable roof bolting machine having power requiring elements including mechanisms for rotating the roof drill, mechanisms for providing thrust to the roof drill, and mechanisms for tramming or moving the vehicle from one position to another. The system includes a single hydraulic pump which is routed through a conventional gear flow divider in order to proportion the amount of hydraulic fluid being provided by the pump. The drill rotating and thrusting mechanisms of the vehicle are, in turn, powered by the hydraulic fluid lines coming from the flow divider. In order to efficiently utilize the hydraulic elements incorporated within the present system, a switching mechanism is employed for providing either the tramming system or one of the other drill mechanisms with the necessary hydraulic fluid for powering the same.

The system additionally includes, as an integral portion thereof, a flow proportioner associated with the tramming mechanism of the vehicle. The use of the flow proportioner permits an infinite variable hydraulic flow valve to the tramming motors for smooth acceleration and movement of the vehicle within the mine.

Accordingly, it is a primary object and feature of the present invention to provide a simplified and efficient hydraulic actuating system for a multi-function mine vehicle.

It is a general object and feature of the present invention to provide a portable self-propelled mine bolting and drilling vehicle having a simplified, uncomplicated, and efficient hydraulic system for powering all the necessary hydraulic units included in a vehicle of this type through a single hydraulic pump.

It is another object and feature of the present invention to provide a mine vehicle having a flow proportioner included as a portion thereof for gradually gating the flow of hydraulic fluid to the vehicles tramming motors for smooth and gradual acceleration of the vehicle.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the annexed claims. The invention itself, however, both as to its structure and its operation together with the additional objects and advantages thereof, will best be understood from the following description of the preferred embodiment of the invention when read in conjunction with the accompanying drawings wherein:

DETAILED DESCRIPTION OF THE INVENTION

Figure 1:
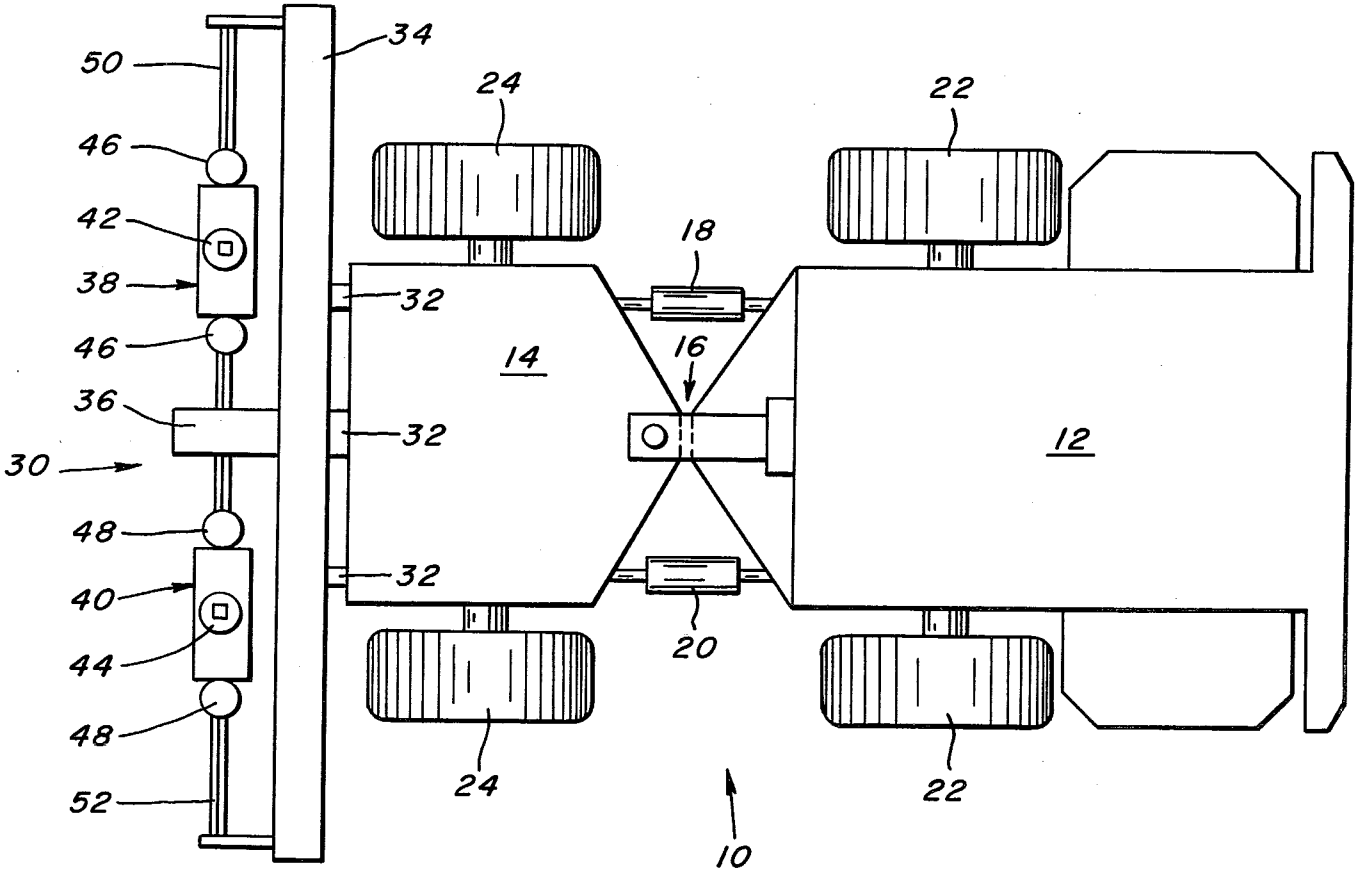
FIG. 1 is a plan view of a mine roof drilling vehicle with which the present invention is associated.

A simplified roof drilling vehicle employed for drilling a plurality of holes in a mine roof from a given position is shown in FIG. 1. Referring to FIG. 1, there is shown a plan view of a roof drilling vehicle 10. The vehicle 10 is preferably configured having a two-section body (although a single-section chassis may be employed) which is articulated for ease of maneuverability within the mine. The vehicle has a rear section 12 and a forward section 14 articulated to each other through appropriate linkages as at 16. Hydraulic actuation units, as at 18 and 20, permit "automatic" articulation of the vehicle 10 through its two sections 12 and 14. Each of the sections 12 and 14 has one pair of tired wheels or the like 22 and 24, respectively. The vehicle is driven through its tires by right and left tramming motors 112 and 106, respectively (see FIGS. 2 and 3).

Attached to the front of the forward section 14, through brackets 32, is a dual element drilling assembly 30. The assembly is configured having an elongated structural member 34 and a shortened structural member 36 attached and normally oriented thereto as indicated in FIG. 1. The assembly is configured having two drilling units 38 and 40 each including a conventional hydraulic powered rotatable drilling head 42 and 44, respectively, and hydraulically actuated jacks or the like as at 46 and 48, respectively. The rotatable drilling heads 42 and 44 provide the necessary rotation to the drill steel and associated drill tip while the jacks 46 and 48 provide the additional upward thrust to the drill head, drill steel, and associated drill tips. The two drilling units 38 and 40 are mounted on support members 50 and 52, respectively for lateral movement of the two units 38 and 40 so as to permit each unit to drill two or more roof holes from a given vehicle location. The drilling units 38 and 40 and associated centered drill head and supports are described and claimed in a copending application for United States Patent entitled "Centered Drill Head Apparatus" by Walter Hood and Joseph Subrick, Ser. No. 687,113, filed simultaneously herewith and assigned to the assignee of the present invention. For further details of the drilling units 38 and 40, as well as their operation, reference should be made to the abovenoted application. In addition, a roof drilling vehicle employing the centered drill head concept in a rotatable arrangement is described and claimed in an addition copending application for United States Patent entitled "Rotatable Mine Drilling Apparatus" by Walter Hood, Joseph Subrick and Woods G. Talman, Ser. No. 687,112, filed simultaneously herewith and assigned to the assignee of the present invention.

Figure 2:
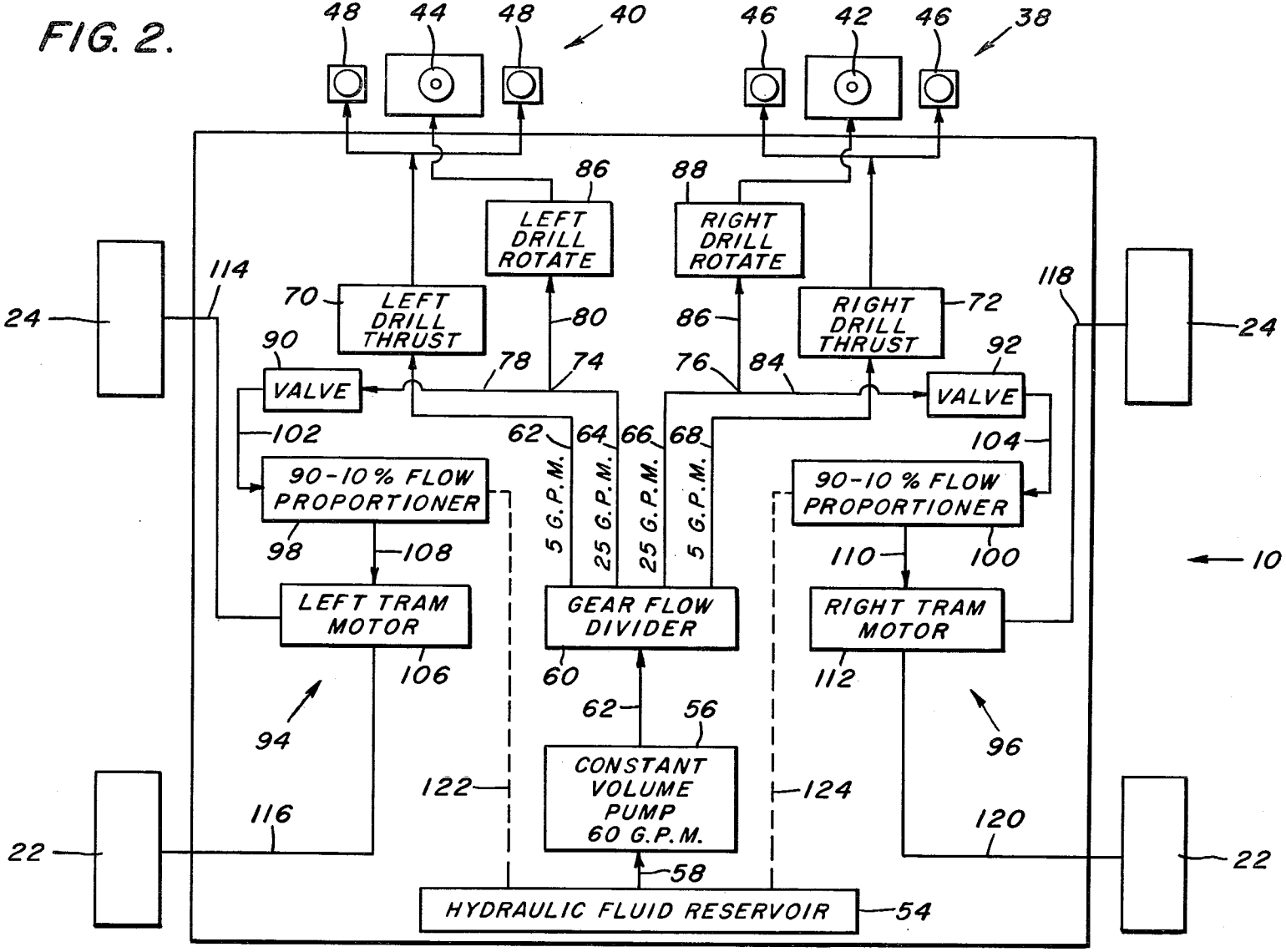
FIG. 2 is a schematic representation of the hydraulic flow divider system according to the present invention.
Figure 3:
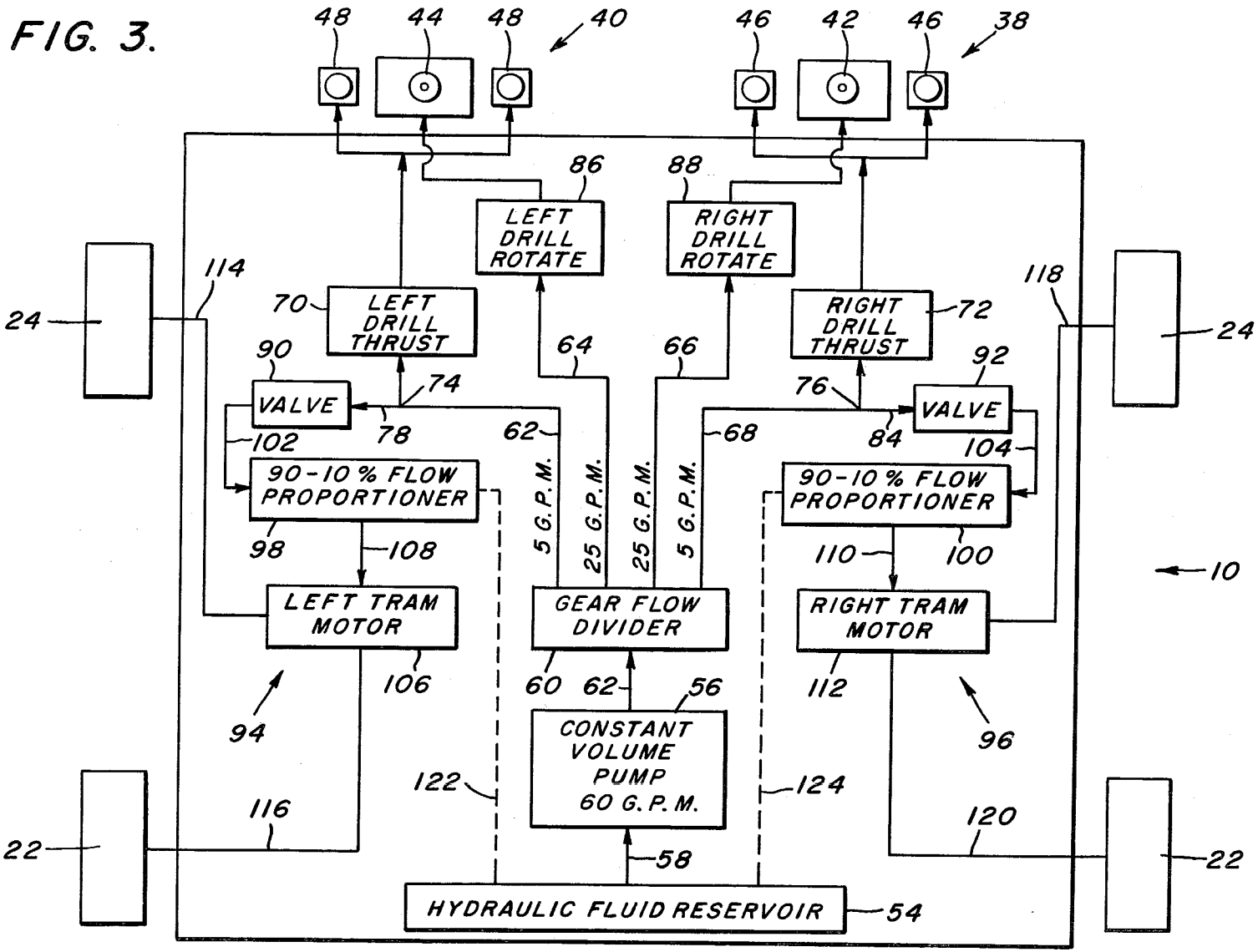
FIG. 3 is an alternative embodiment of the hydraulic flow divider system of the present invention.

Looking to FIGS. 2 and 3, there are shown a preferred and an alternative embodiment of the hydraulic flow divider and proportioning system according to the present invention. As may be evidenced from FIGS. 2 and 3, there is located a hydraulic fluid reservoir 54 which supplies the necessary hydraulic fluid (not indicated) to a constant volume hydraulic pump 56 through an appropriate hydraulic line 58. The pump 56 is configured to deliver a constant volume of hydraulic fluid (in this case, 60 gallons per minute) to a gear flow divider 60 through a line 62. Both the constant volume pump 56 and the gear flow divider 60 are relatively conventional items and are manufactured by several companies involved in hydraulics.

The gear flow divider 60 is operative to take the 60 G.P.M. input from the pump 56 and selectively divide in into four separate and independent feeder lines 62, 64, 66 and 68 having rated outputs of 5 G.P.M., 25 G.P.M., 25 G.P.M., and 5 G.P.M., respectively. Lines 62 and 68, each having ratings of 5 G.P.M., are employed to provide hydraulic fluid to both the left and right drill thrusting units 70 and 72, respectively. Each of these thrusting units operates the hydraulic jacks 46 and 48 which move the drill heads 42 and 44, respectively, upwardly toward the mine roof.

The remaining two lines 64 and 66, each having flow rates of 25 gallons per minute, separate at points 74 and 76, respectively to form lines 78 and 80, and 82 and 84, respectively. The lines 80 and 82 are employed to provide hydraulic fluid at flow rates of 25 G.P.M. to the left and right drill rotating mechanisms 86 and 88, respectively. The drill rotating mechanisms 86 and 88 provide the necessary power for rotating drill heads 44 and 42, respectively. The remaining lines 78 and 84 lead to two divider valves or hydraulic switches 90 and 92. The divider valves 90 and 92 operate to switch the hydraulic flow between either the drill rotate mechanisms 86 and 88 or to hydraulic left and right tramming circuits 94 and 96. Inasmuch as drill rotation does not occur while the vehicle is trammed and vice versa, the valves 90 and 92 may be operated to switch to one line or the other without adversely affecting proper operation. In this regard, it should be noted that this efficient use of the system's hydraulics provides for greater economic and hardware reduction.

The two tramming circuits 94 and 96 each include a 90%-10% flow proportioner as at 98 and 100, attached to the divider valves 90 and 92 through hydraulic lines 102 and 104, respectively. Flow proportioner 98 functions to provide the left tram motor 106, through line 108, with an infinitely variable flow of hydraulic fluid of between 90% to 10% of the available fluid to it (25 G.P.M.) Similarly, the flow proportioner 100 is operative to provide, through line 110, the right tram motor 112 with the same variety of settings. The left and right tram motors 106 and 112, respectively, serve to power the left and right sides of the vehicle 10 for locomotion through the mine. These power lines are indicated at 114, 116, 118, and 120.

The use of flow proportioners for tramming purposes has been long needed in the mining vehicle field. Under current conditions, tramming is accomplished through a full power or no power switching arrangement with proper braking for turning and stopping, an obviously undesirable and very dangerous condition. In the present system, the tram motors may be gradually fed more and more or less and less hydraulic fluid to effect a gradual acceleration or deceleration, a condition not found in current machines. The inclusion of such an operation in a mining vehicle is not only desirable, it is necessary for the proper and safe operation of the vehicle.

The flow proportioners 98 and 100 are operative to provide to the tramming motors 106 and 112 between 10% and 90% of the available hydraulic fluid, i.e., 25 G.P.M. That amount of the available hydraulic fluid not provided to the two motors 106 and 112 for tramming purposes is routed back, through lines 122 and 124, indicated by dashes in FIGS. 1 and 2, to the hydraulic fluid reservoir 54 for continued use through the system.

The simplicity of the present hydraulic system can only be appreciated when it is compared to the currently available systems used to hydraulically power the above-noted elements. In particular, these systems include six hydraulic pumps and associated regulators for the six different hydraulic functions just discussed. Moreover, the plethora of lines and valves necessary for properly attaching and connecting the pumps to the reservoir and the functional elements leads to massive confusion, costs and maintenance, all of which are totally unnecessary. The simplicity of the present system provides for cost reduction at every step between system installation and system maintenance.

An alternative embodiment of the present invention is shown in FIG. 3. As may be evidenced by referring to that Figure, the hydraulic independence of the drill thrusting mechanisms 70 and 72 of the preferred embodiment of FIG. 1 has now been switched with the drill rotating mechanisms 86 and 88. The tramming circuits are now interconnected not with the drill rotating mechanisms but with the drill thrusting mechanisms. The lines 64 and 66 now connect directly to the drill rotating mechanisms while the lines 62 and 68 branch at points 74 and 76 to lead to the drill thrusting and tramming mechanisms.

It should be seen that the present hydraulic flow dividing and proportioning system, whether employed alone or in conjunction with a roof drilling vehicle, provides a simplified, inexpensive, and easily maintained substitute for the complicated, costly, and difficult to maintain current systems. The system advantageously provides for an improved hydraulic tramming circuit for smooth vehicle acceleration and deceleration. As such, the possibility of accidents and loss of lives is greatly reduced. The present hydraulic system provides for all of the necessary roof drilling functions in a simple and orderly manner. As such, it solves the problems associated in this regard which plague current vehicles.

Accordingly, while certain changes may be made in the above-noted system and vehicle without departing from the scope of the invention herein involved, it is intended that all matter contained in the above description or shown in the accompanying drawings shall be interpreted as illustrative and not in a limiting sense.

I claim:

1. A hydraulic flow divider system for a multi-function mine roof bolting vehicle, such vehicle having at least one drill head requiring a hydraulic input for rotating a drill steel, at least one drill head thrusting mechanism requiring hydraulic input for moving such drill head and drill steel toward the mine roof, and at least one tramming system requiring hydraulic input for moving at least one side of such bolting vehicle, said hydraulic flow divider system comprising:

means for retaining a quantity of hydraulic actuating fluid;

a pump for pumping such fluid from said retaining means at a constant volume;

means for dividing the flow of such fluid from said pump into at least two given constant volume flow paths, one of said paths providing hydraulic fluid to one of the elements requiring hydraulic input, the other flow path being split between the tramming system and the remaining hydraulic input requiring element;

a divider valve for switching said other hydraulic flow path either to the tramming system or to the remaining hydraulic input requiring element; and means for proportioning hydraulic flow, located between said divider valve and such tramming system for permitting a gradual flow of such hydraulic fluid to such tramming system for a smooth acceleration of such vehicle.

2. The hydraulic flow divider system of claim 1 in which said flow proportioning means is configured to provide the tramming system with a variable flow of hydraulic fluid, the difference in the hydraulic fluid available to the flow proportioning means and that which is provided to the tramming system being returned to the hydraulic fluid retaining means.

3. The hydraulic flow divider system of claim 1 in which said flow proportioning means is operative to provide the tramming system with a variable flow of hydraulic fluid when, and only when, said divider valve switches the hydraulic flow path to the tramming system.

4. A hydraulic flow divider system for a multi-function mine roof bolting vehicle, such vehicle having two drill heads requiring a hydraulic input for rotating drill steels associated therewith, two drill head thrusting mechanisms requiring hydraulic input for moving such drill heads and drill steels toward the mine roof, and two tramming systems requiring hydraulic input for moving one side of such bolting vehicle each, said hydraulic flow divider system comprising:

hydraulic fluid reservoir means for retaining a quantity of hydraulic actuating fluid;

a pump for pumping such fluid from said retaining means at a constant volume;

a gear flow divider for dividing the flow of such fluid from said pump into at least four given constant volume flow paths, two of said paths providing hydraulic fluid to the drill head thrusting mechanisms, the other two flow paths each being split between the tramming system and the drill rotating mechanisms;

a divider valve for switching the flow of hydraulic fluid either to the tramming system or to the drill rotating mechanisms;

means for proportioning hydraulic flow, located between said divider valve and such tramming system for permitting a gradual flow of such constant volume hydraulic fluid to such tramming system for a smooth acceleration of such vehicle.

5. A hydraulic flow divider system for a multi-function mine roof bolting vehicle, such vehicle having two drill heads requiring a hydraulic input for rotating drill steels associated therewith, two drill head thrusting mechanisms requiring hydraulic input for moving such drill heads and drill steels toward the mine roof, and two tramming systems requiring hydraulic input for moving one side of such bolting vehicle each, said hydraulic flow divider system comprising:

hydraulic fluid reservoir means for retaining a quantity of hydraulic actuating fluid;

a pump for pumping such fluid from said retaining means at a constant volume;

a gear flow divider for dividing the flow of such fluid from said pump into at least four given constant volume flow paths, two of said paths providing hydraulic fluid to such drill rotating mechanisms, the other two flow paths each being split between the tramming system and the drill thrusting mechanisms;

a divider valve for switching the flow of hydraulic fluid either to the tramming system or to the drill thrusting mechanisms; and means for proportioning hydraulic flow, located between said divider valve and such tramming system for permitting a gradual flow of such constant volume hydraulic flow to such tramming system for a smooth acceleration of such vehicle.

6. A portable self-propelled roof bolting vehicle for drilling holes within a mine roof for roof bolting purposes, said vehicle including:

a housing;

means for drilling vertical holes into such mine roof including means for rotating the drill steel associated with said drilling means and means for providing an upward thrust to said rotating means, said drilling means being hydraulically actuated;

means hydraulically actuated, for moving said vehicle from one location to another; and a hydraulic flow divider system for providing hydraulic fluid to said drilling means including said rotating means, said thrusting means, and said moving means, said hydraulic flow divider system comprising:

hydraulic fluid reservoir means for retaining a quantity of hydraulic fluid;

a pump for pumping such fluid from said retaining means into at least four given constant volume flow paths, two of said paths providing hydraulic fluid to said drill thrusting means, the other two flow paths each being split between the means for moving said vehicle and said drill rotating means;

a divider valve for switching the flow of hydraulic either to said moving means or to said drill rotating means; and means for proportioning hydraulic flow, located between said divider valve and said tramming system, for permitting a gradual flow of such constant volume hydraulic fluid to said vehicle moving means for a smooth acceleration of said vehicle.

7. The portable self-propelled roof bolting vehicle of claim 6 in which said flow proportioning means is configured to provide said vehicle moving means with a variable flow of hydraulic fluid, the difference in the hydraulic fluid available to said flow proportioning means and that which is provided to said moving means being returned to said hydraulic reservoir means.

8. The portable self-propelled roof bolting vehicle of claim 6 in which said flow-proportioning means is operative to provide said vehicle moving means with a variable flow of hydraulic fluid when, and only when, said divider valve switches the hydraulic flow path to said vehicle moving means.

9. A portable self-propelled roof bolting vehicle for drilling holes within a mine roof for roof bolting purposes, said vehicle including:

a housing means for drilling vertical holes into such mine roof including means for rotating the drill steel associated with said drilling means and means for providing an upward thrust to said rotating means, said drilling means being hydraulically actuated;

means hydraulically actuated, for moving said vehicle from one location to another; and a hydraulic flow divider system for providing hydraulic fluid to said drilling means including said rotating means, said thrusting means, and said moving means, said hydraulic flow divider system comprising;

hydraulic fluid reservoir means for retaining a quantity of hydraulic fluid;

a pump for pumping such fluid from said retaining means into at least four given constant volume flow paths, two of said paths providing hydraulic fluid to said drill rotating means, the other two flow paths each being split between said means for moving said vehicle and said drill thrusting means;

a divider valve for switching the flow of hydraulic fluid either to said moving means or to said drill thrusting means; and means for proportioning hydraulic flow, located between said divider valve and said tramming system, for permitting a gradual flow of such constant volume hydraulic fluid to said vehicle moving means for a smooth acceleration of said vehicle.

10. The portable self-propelled roof bolting vehicle of claim 9 in which said flow proportioning means is configured to provide said vehicle moving means with a variable flow of hydraulic fluid, the difference in the hydraulic fluid available to said flow proportioning means and that which is provided to said moving means being returned to said hydraulic reservoir means.

11. The portable self-propelled roof bolting vehicle of claim 9 is which said flow proportioning means is operative to provide said vehicle moving means with a variable flow of hydraulic fluid when, and only when, said divider valve switches the hydraulic flow path to said vehicle moving means.

* * * * *

UNITED STATES PATENT OFFICE

CERTIFICATE OF CORRECTION

Patent No. 4,068,728 Dated January 17, 1978

Inventor(s) Joseph Subrick

It is certified that error appears in the above-identified patent and that said Letters Patent are hereby corrected as shown below:

Column 1, line 51, change "premissible" to -- permissible --.

Column 3, line 62, after "Ser. No. 687,113", insert

-- our Docket 1523 --.

Column 4, line 4, after "Ser. No. 687,112", insert

-- our Docket 1522 --.

Column 4, line 22, change "in" to -- it --.

Column 6, line 22, after "such", insert -- constant volume --.

Signed and Sealed this

Sixteenth Day of May 1978

[SEAL]

Attest:

RUTH C. MASON
Attesting Officer

LUTRELLE F. PARKER
Acting Commissioner of Patents and Trademarks